US005908255A

United States Patent [19]

Branch

[11] Patent Number: 5,908,255

[45] Date of Patent: Jun. 1, 1999

[54] DEICING AND SNOW BROOM DEVICE

[76] Inventor: Derico S. Branch, 1660 Lanier Pl., NW. Suite 217, Washington, D.C. 20009

[21] Appl. No.: 08/926,451

[22] Filed: Sep. 10, 1997

Related U.S. Application Data

[60] Provisional application No. 60/025,998, Sep. 12, 1996.

[51] Int. Cl.[6] ..... A47L 1/08; A47L 1/16

[52] U.S. Cl. ..... 401/139; 401/27; 401/137

[58] Field of Search ..... 401/137, 139, 401/27

[56] References Cited

U.S. PATENT DOCUMENTS

| | | | |
|---|---|---|---|
| 1,679,843 | 8/1928 | Traube | 401/139 |
| 2,436,454 | 2/1948 | Sensenbach et al. | 401/139 |
| 2,741,789 | 4/1956 | Ray | 401/139 |
| 2,770,826 | 11/1956 | Curfman | 401/139 |
| 3,603,692 | 9/1971 | Ball | 401/139 |
| 4,778,201 | 10/1988 | Sieotte | 401/139 |
| 4,955,747 | 9/1990 | Tarver | 401/139 |
| 5,168,935 | 12/1992 | Thornbury et al. | 401/139 X |

FOREIGN PATENT DOCUMENTS

| | | | |
|---|---|---|---|
| 635741 | 4/1983 | Switzerland | 401/139 |

*Primary Examiner*—Steven A. Bratlie

*Attorney, Agent, or Firm*—Nikaido, Marmelstein, Murray & Oram LLP

[57] ABSTRACT

A surface cleaning device including a body having a bottom, an upper end extending in parallel with the bottom, and a boss extending perpendicular to a bottom and the upper end. A handle is threadingly engaged at one end with the boss. A hollow chamber extends the length of the body. A single edge surface engaging part is provided on the upper end of the body. A surface clearing part is provided on the bottom of the body. A pump spray device is engaged with the other end of the handle and extending into the hollow chamber for pumping and spraying fluid contained in the hollow chamber. In one embodiment, single edge surface engaging part on the upper end of the body is a scraper blade; and the surface clearing part on the bottom of the body is a brush. In another embodiment, the single edge surface engaging part on the upper end of the body is a squeegee blade; and the surface clearing part on the bottom of the body is a sponge.

3 Claims, 4 Drawing Sheets

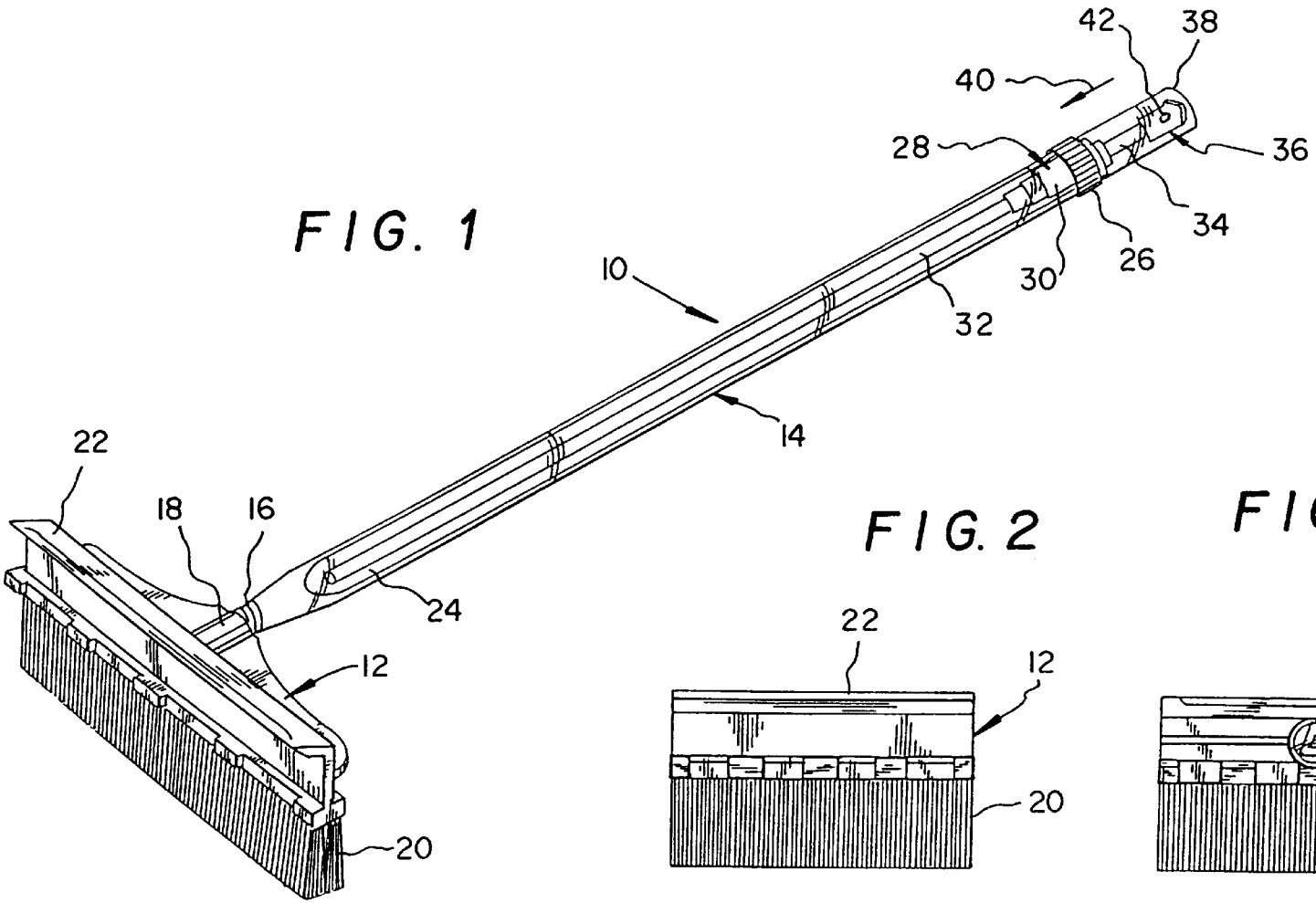
FIG. 1
FIG. 2
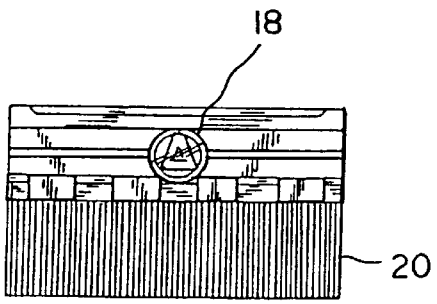
FIG. 3

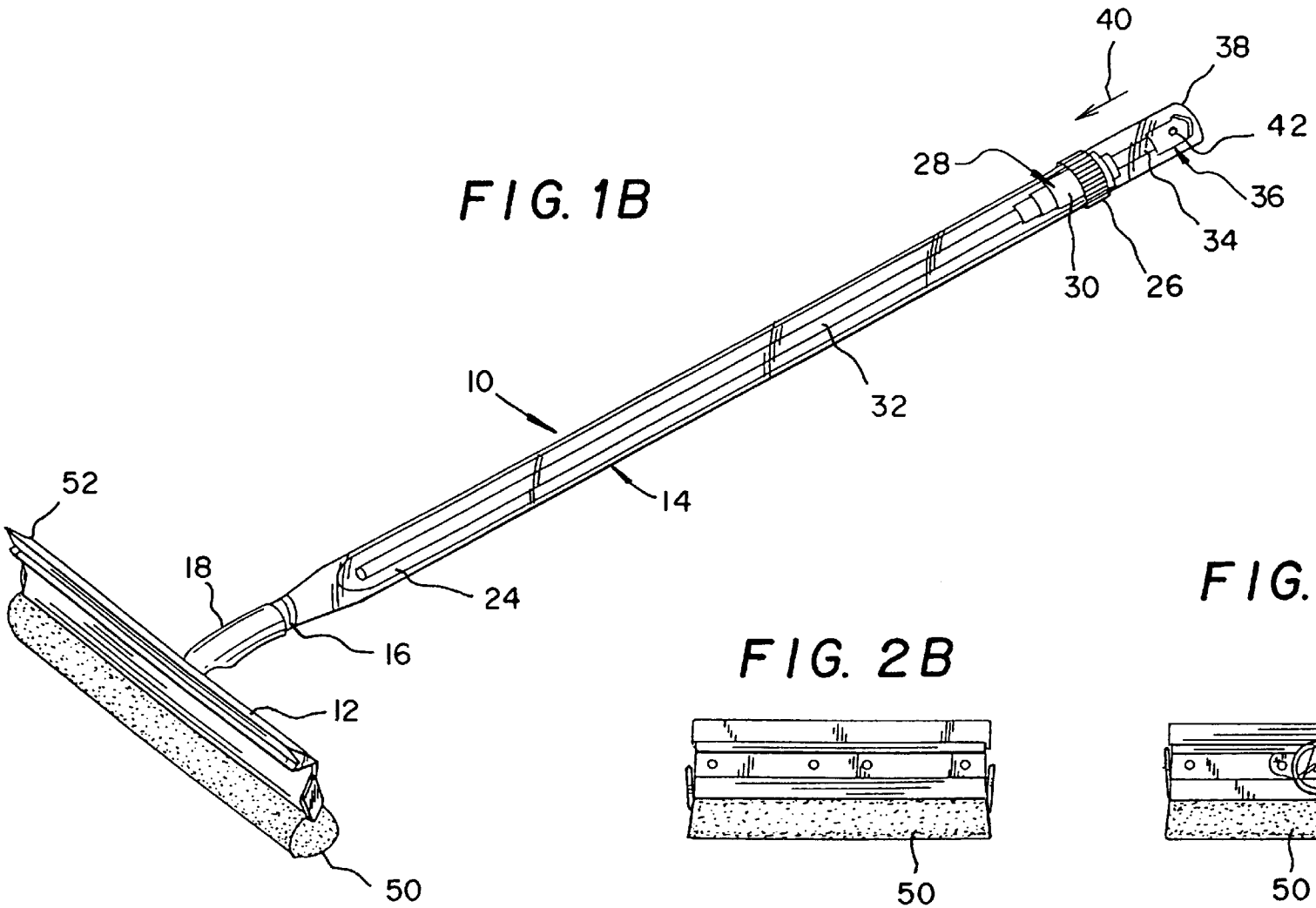
FIG. 1B
FIG. 2B
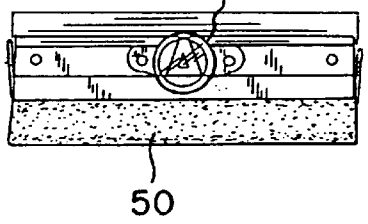
FIG. 3B 12
20
22
10
14
32
26
36
38

36
26
10
14
20
22
12

36
42
26
10
14
32

20
10
14
32
26
36

52
50
10
14
26
38
36

36
26
10
14
52
50

50
36
26
10
14
50

10
14
26
36

DEICING AND SNOW BROOM DEVICE

This is a complete application of Provisional Application No. 60/025,998, filed Sep. 12, 1996.

BACKGROUND OF THE INVENTION

The present invention relates to a deicing and scraping broom for removing ice and snow from vehicle windshields and other surfaces where it is formed. During the winter season, motorists experience much difficulty in removing ice and snow from off the windshield and window glass. In particular, the present invention relates to a high output pump spray dispensing device that allows deicing fluid to flow through the handle of the snow broom causing the ice to melt. The problem with the ice on the vehicle windshield is that it is very hard to remove.

OBJECTS OF THE INVENTION

It is therefore an object of the present invention to provide a safe and easy deicing snow broom and scraping device which is easily gripped with one hand minimizing the need to exert pressure on the windshield or a like surface to remove hard ice. Further it is an object of the present invention to provide a dispenser which is simple and economical to construct. These and other objects will become increasingly apparent by reference to the following description and drawings.

BRIEF DESCRIPTION OF THE DRAWINGS

The present invention will become readily apparent by reference to the following detailed description when considered in conjunction with the accompanying drawings wherein:

FIG. 1 is a perspective view of the deicing and snow broom device of the present invention. In the particular embodiments shown, the handle portion of the device is made of color plastic so that the details of the dip tube, spray pump and actuating push valve can be seen;

FIG. 2 is a front end, elevational view of the device;

Figures 4, 5, 6, 7:
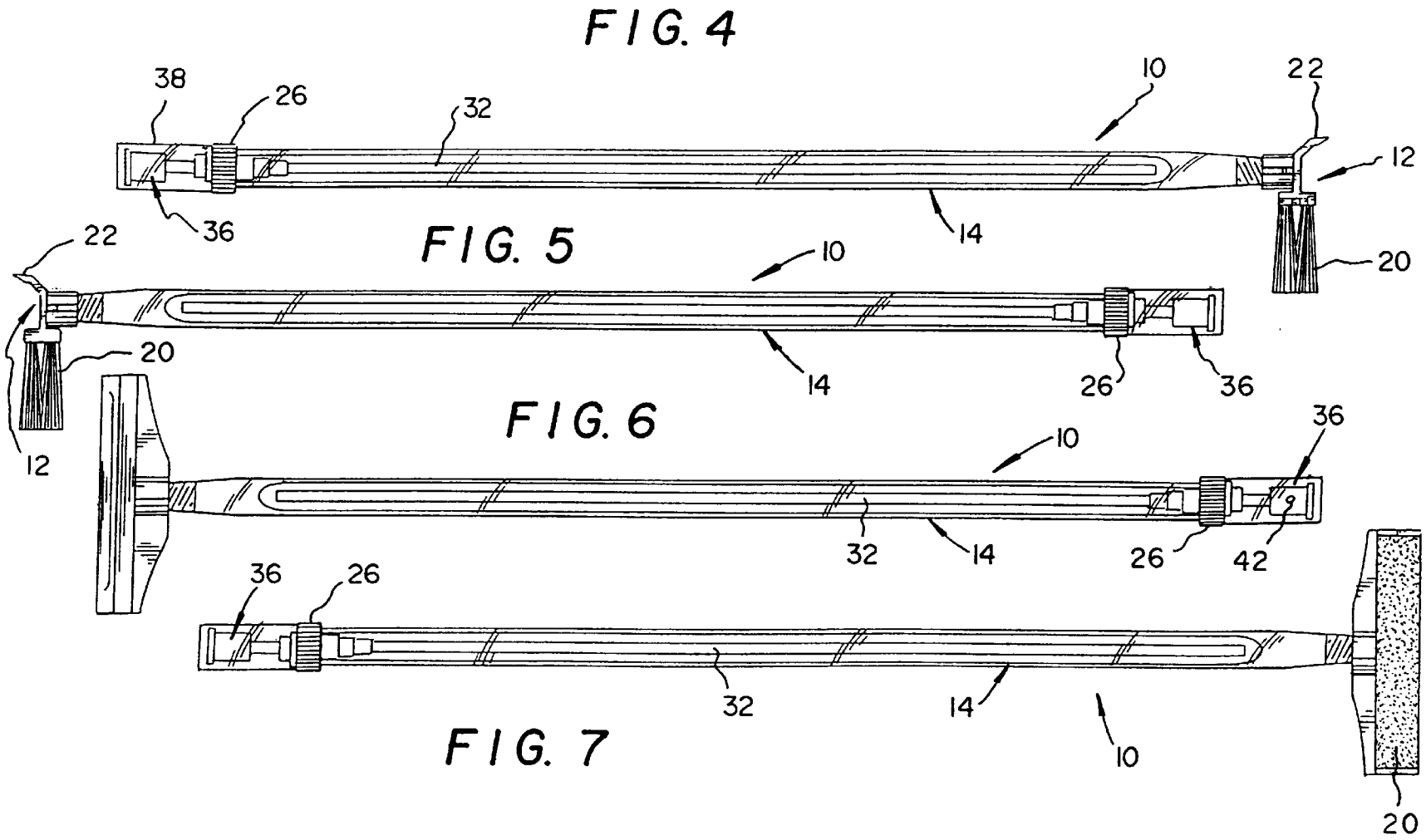
Figures 4B, 5B, 6B, 7B:
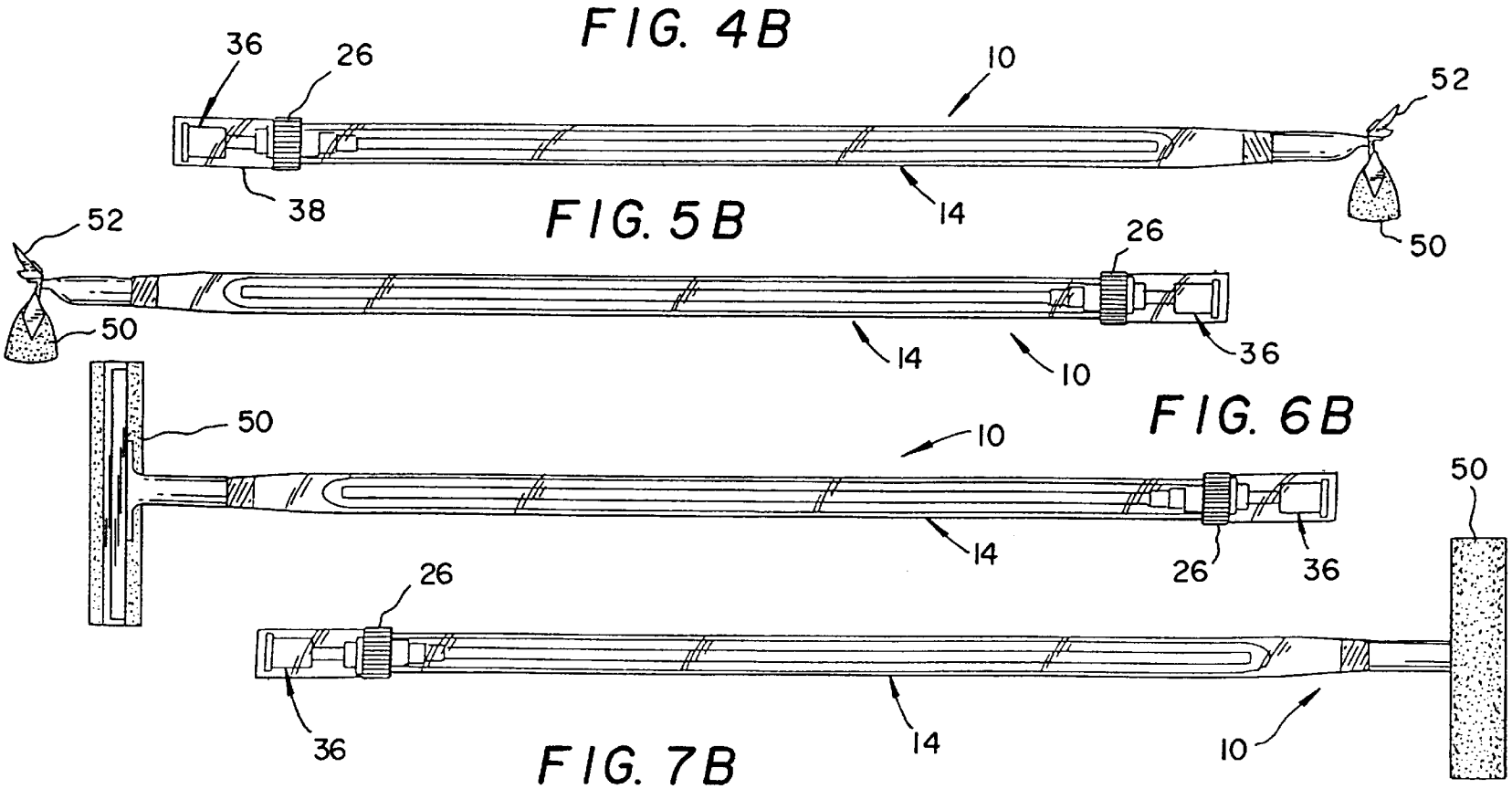

FIG, 3 is a rear end elevational view of the device;

FIG. 4 is a left hand side elevational view;

FIG. 5 is a right hand side elevational view;

FIG. 6 is a top plan view;

FIG. 7 is a bottom plan view;

FIG. 1B is a perspective view of another embodiment of the invention similar to FIG. 1;

FIG. 2B is a front end elevational view of the device of FIG. 1B;

FIG. 3B is a rear end elevational view of the device of FIG. 1B;

FIG. 4B is a left hand side elevational view of the device of FIG. 1B;

FIG. 5B is a right hand side elevational view of the device of FIG. 1B;

FIG. 6B is a top plan view of the device of FIG. 1B; and

FIG. 7B is a bottom plan view of the device of FIG. 1B.

DETAILED DESCRIPTION OF PREFERRED EMBODIMENTS

FIG. 1 shows the deicing and snow broom device 10 of the invention which includes a body portion 12 and a handle portion 14. Handle 14 is screwed into the body 12 with an external thread 16 engaging an internal complementary thread, not shown, in the boss 18 of the body 12. A broom brush 20 is located at the bottom of body portion 12, and a scraper blade 22 is located at the upper end of the body 12. The body 12 can be molded integrally with the scraper blade 22 and a broom 20.

An inside chamber 24 of the hollow handle 14 is designed to contain deicing liquid which is sealed in the chamber 24 by a cap 30 which threads onto the end of the handle 14. A spray pump device 28 is attached to the cap 26 and extends inwardly into the chamber 24 with a pump 30 to which an inlet dip tube 32 is attached. A plunger tube 34 is attached to the pump 30 and extends outwardly from the cap 26 to a dispensing nozzle 36. A transparent cover 38 slips on and is attached to the cap 26 to protect the nozzle 36 when not in use.

When the nozzle 36 is pushed downwardly in the direction of arrow 40, the deicing liquid is delivered from the chamber 24 through the dip tube 32, pump device 28 which includes the pump 30 and the plunger tube 34 to the dispensing nozzle 36 and out the dispensing orifice 42 toward the surface at which it is aimed by the user.

In the embodiment of FIGS. 1B–7B, the brush 20 on body 12 has been replaced by a sponge 50, and the scraper 22 which is usually stiff to cut ice can be replaced by a more flexible squeegee blade 52. Otherwise the functioning elements of the embodiment of FIGS. 1B–7B are the same as the elements of FIGS. 1–7 and like parts have been given the same numeral.

In use during the winter season when ice occurs on the windshield and other windows of the user's automobile, my deicer and snow broom device 10 is used by removing the cover 38 and aiming the dispensing nozzle 36 at the iced surface. When the dispensing nozzle 36 is pressed downwardly, the deicing fluid will pass through the dispensing orifice 42 onto the iced surface to start the melting process. The handle 14 can be grasped in one hand and the scraper blade 22 can be used to loosen and break up the ice so that it may be swept away by the brush 20. The deicing fluid may be replaced by removing the cap 36 and pouring fluid into the chamber 24.

The embodiment of FIGS. 1B–7B can be used in a like manner or may be used more often in the summer time when the sponge 50 is used to distribute and to clean the glass surface after cleaning fluid has been dispensed from the nozzle 36 in the manner already explained.

The squeegee blade 52 can then be used to remove excess water and produce a dry glass surface.

It is readily apparent that the above-described has the advantage of wide commercial utility. It should be understood that the specific form of the invention hereinabove described is intended to be representative only, as certain modifications within the scope of these teachings will be apparent to those skilled in the art. Accordingly, reference should be made to the following claims in determining the full scope of the invention.

I claim:

1. A deicing device for removing ice from a surface comprising:

a body portion constructed from a durable water resistant material having an upper portion, a lower portion, and first and second ends, wherein the first end has a threaded socket;

a transparent tube shaped handle having first and second handle ends wherein the first handle end has a tapered portion threadingly received in the threaded socket in the first end of the body portion and wherein the transparent tube shaped handle further has a hollow chamber extending therethrough and opening at the second handle end;

a stiff blade shaped engaging part located on the upper portion of the body portion and positioned perpendicularly to the handle for engaging and loosening ice on the surface;

a broom on the lower portion of the body portion, the broom having stiff water resistant bristles adapted for removing loosened ice from the surface; and a pump spray device having an engaging portion for engaging the second handle end in a leak proof connection wherein a dip tube extends from the pump spray device into the hollow chamber, whereby a deicing liquid stored inside the hollow chamber can be expelled onto the surface to melt the ice by the pump spray device.

2. The deicing device of claim 1 further comprising a reinforcing body extending from the first end of the body portion such that the threaded socket extends through the reinforcing body.

3. A deicing device for removing ice from a surface comprising:

an elongated body portion having a scraping implement longitudinally extending from one side of the body portion and a sweeping portion longitudinally extending from an opposite side of the body portion wherein said scraping implement has an angled end portion that extends from said scraping implement and tapers to a sharp edge that is adapted for loosening ice attached to the surface and wherein said sweeping portion has a plurality of closely spaced stiff bristles extending perpendicularly away from said body portion for sweeping away ice loosened by the scraping implement;

a reinforcing portion extending perpendicularly from said elongated body portion along an area between said scraping implement and said sweeping portion wherein said reinforcing portion has a threaded socket centrally located in said reinforcing portion and tapered portions extending outward from said threaded socket toward opposite ends of said elongated body portion;

a transparent plastic tube shaped handle dimensioned to fit comfortably in the hand of a user having first and second handle ends, wherein said first handle end has a tapered portion threadingly received by said threaded socket in said reinforcing portion and said second handle end has a circular receiving opening, and wherein said transparent plastic tube shaped handle further has a hollow chamber extending through a center portion such that said hollow chamber is closed at said first handle end and said hollow chamber is open at said circular receiving opening, and wherein said hollow chamber holds a deicing liquid for causing ice to melt; and a pump spray device having a plunger type pump sprayer head, a pumping mechanism, a cap, and a dip tube wherein said dip tube is received in said hollow chamber and provides deicing liquid to said pumping mechanism, said cap sealingly connects said pumping mechanism to said circular receiving opening, and said plunger type sprayer head receives deicing liquid from said pumping mechanism and expels said deicing liquid when said plunger type pump sprayer head is pushed toward said hollow chamber.

* * * * *